US008913719B2

(12) United States Patent
Kuribayashi et al.

(10) Patent No.: US 8,913,719 B2
(45) Date of Patent: Dec. 16, 2014

(54) ELECTRON GUN, X-RAY GENERATOR AND X-RAY MEASUREMENT APPARATUS

(71) Applicant: Rigaku Corporation, Akishima-shi (JP)

(72) Inventors: Masaru Kuribayashi, Akishima (JP); Masahiro Nonoguchi, Hino (JP); Masashi Kageyama, Ome (JP)

(73) Assignee: Rigaku Corporation, Akishima-Shi, Tokyo (JP)

( * ) Notice: Subject to any disclaimer, the term of this patent is extended or adjusted under 35 U.S.C. 154(b) by 161 days.

(21) Appl. No.: 13/780,131

(22) Filed: Feb. 28, 2013

(65) Prior Publication Data

US 2013/0259197 A1 Oct. 3, 2013

(30) Foreign Application Priority Data

Mar. 27, 2012 (JP) ..... 2012-072552

(51) Int. Cl.

| | |
|---|---|
| ***H01J 35/06*** | (2006.01) |
| ***H01J 1/88*** | (2006.01) |
| ***H01J 3/02*** | (2006.01) |
| ***H01J 35/14*** | (2006.01) |

(52) U.S. Cl.

CPC . *H01J 1/88* (2013.01); *H01J 35/06* (2013.01); *H01J 3/027* (2013.01); *H01J 35/14* (2013.01)

USPC ..... 378/134

(58) Field of Classification Search

USPC ..... 378/119, 123, 134, 136, 138, 64; 313/243

See application file for complete search history.

(56) References Cited

U.S. PATENT DOCUMENTS

| | | | | |
|---|---|---|---|---|
| 3,478,244 | A * | 11/1969 | Scheffels Wilhelm et al. | 313/237 |
| 5,060,254 | A * | 10/1991 | de Fraguier et al. | 378/136 |
| 5,703,924 | A * | 12/1997 | Hell et al. | 378/136 |
| 6,661,876 | B2 * | 12/2003 | Turner et al. | 378/138 |
| 7,333,592 | B2 | 2/2008 | Nonoguchi et al. | |
| 7,529,345 | B2 * | 5/2009 | Bard et al. | 378/136 |
| 7,769,139 | B2 * | 8/2010 | Sakabe | 378/123 |
| 2001/0019601 | A1 | 9/2001 | Tkahashi et al. | |
| 2003/0201705 | A1 * | 10/2003 | Ricaud et al. | 313/346 R |
| 2007/0058782 | A1 | 3/2007 | Okada et al. | |
| 2007/0092064 | A1 | 4/2007 | Kuribayashi et al. | |

FOREIGN PATENT DOCUMENTS

| | | | |
|---|---|---|---|
| DE | 28 21 597 | A1 | 11/1979 |
| GB | 774240 | A | 5/1957 |
| GB | 2 021 310 | A | 11/1979 |
| JP | 2007-066694 | A | 3/2007 |
| JP | 2007-115553 | A | 5/2007 |

* cited by examiner

*Primary Examiner* — Irakli Kiknadze

(74) *Attorney, Agent, or Firm* — Buchanan Ingersoll & Rooney PC

(57) ABSTRACT

An electron gun having: a cathode for emitting electrons; a first Wehnelt electrode equipped with a first aperture through which electrons are allowed to pass; and a second Wehnelt electrode that is equipped with a second aperture disposed at a predetermined position with respect to the cathode and the first aperture, and that is furnished at a position closer to the cathode than the first Wehnelt electrode, wherein: the cathode and the second Wehnelt electrode are included within a single assembly constituting a unitary body; and the assembly is detachably attached to the first Wehnelt electrode. Replacement of the cathode can be performed by detaching the cathode unit from the first Wehnelt electrode, and then ejecting the cathode unit out from the Wehnelt cover. The emitter of the cathode can thereby be reliably positioned with respect to the second aperture.

14 Claims, 16 Drawing Sheets

(a)
ENLARGED VIEW

ELECTRON GUN, X-RAY GENERATOR AND X-RAY MEASUREMENT APPARATUS

BACKGROUND OF THE INVENTION

1. Field of the Invention

The present invention relates to an X-ray generator configured such that the advance of electrons generated by a cathode is controlled by a Wehnelt electrode.

2. Description of the Related Art

Typically, in an X-ray generator, electrons generated by a cathode are caused to collide with an anti-cathode. The region of collision of the electrons with the anti-cathode serves as an X-ray focus. X-rays are then generated from this X-ray focus. Techniques for disposing a Wehnelt electrode on the path of advance of the electrons in such an X-ray generator, and controlling the direction of advance of the electrons by the Wehnelt electrode, are known (see Patent Citation 1, for example).

As shown in FIG. 16 which accompanies the description, the X-ray generator shown in Patent Citation 1 has a first Wehnelt electrode 101 provided with a large opening area, and a second Wehnelt electrode 102 provided with a small opening area. A cathode (filament) 103 is disposed within the aperture of the second Wehnelt electrode 102. A voltage V1 is applied across an anti-cathode (target) 104 and the cathode 103. A voltage V2 is applied across the Wehnelt electrodes 101, 102 and the cathode 103.

When the cathode 103 is energized, the cathode 103 radiates heat, generating thermal electrons E. The thermal electrons E, with the direction of advance thereof being controlled by the electrical field formed by the first Wehnelt electrode 101 and the second Wehnelt electrode 102, are accelerated by the voltage V1 and collide with the anti-cathode 104. The region in which the electrons collide is the X-ray focus F, and X-rays are radiated from this X-ray focus F.

In the afore-described conventional X-ray generator, a coil-shaped tungsten filament is employed as the cathode. The first Wehnelt electrode 101 and the second Wehnelt electrode 102 are constituted as an integrated component of a single electrode member. Because the cathode deteriorates with continuous use, it is replaced as needed. During replacement, with the Wehnelt electrodes 101, 102 still disposed at their predetermined positions within the X-ray generator in FIG. 16, the cathode 103 is detached from the second Wehnelt electrode 102, and thereafter the new cathode 103 is attached inside the second Wehnelt electrode 102.

In a case in which the cathode 103 is of a large size, and moreover the accuracy of positioning of the cathode 103 with respect to the second Wehnelt electrode 102 is not so exact, the conventional replacement method can be implemented without difficulty. However, more recently, smaller scale and high brilliance have come to be required of electron sources, which have led to the need for the cathode in such electron sources to be formed to a smaller scale, and for a high degree of accuracy to be stipulated in positioning of the cathode with respect to the second Wehnelt electrode.

In such cases, when the conventional replacement method, specifically, the method whereby, with the Wehnelt electrodes 101, 102 still disposed at their predetermined positions within the X-ray generator, the cathode 103 is detached from the second Wehnelt electrode 102, and thereafter the new cathode 103 is attached inside the second Wehnelt electrode 102, is adopted, it is impossible to position the cathode with the desired positional accuracy with respect to the Wehnelt electrodes 101, 102.

PRIOR ART CITATIONS (Patent Citation 1): JP-A 2007-115553 (pages 5-6, FIG. 7)

SUMMARY OF THE INVENTION

With the afore-described problem in view, it is an object of the present invention to provide an electron gun, an X-ray generator, and an X-ray measurement apparatus, wherein the cathode can be disposed with a high degree of positional accuracy with respect to the Wehnelt electrodes.

The electron gun according to the present invention comprises: a cathode for emitting electrons; a first Wehnelt electrode equipped with a first aperture through which electrons are allowed to pass; and a second Wehnelt electrode that is equipped with a second aperture disposed at a predetermined position with respect to the cathode and the first aperture, and that is furnished at a position closer to the cathode than the first Wehnelt electrode; wherein: the cathode and the second Wehnelt electrode are included within a single assembly constituting a unitary body; and the assembly is detachably attached to the first Wehnelt electrode.

According to the present invention, the assembly that includes the cathode and the second Wehnelt electrode is detachably attached to the first Wehnelt electrode. Then, with the assembly having been assembled into a single body, position adjustments of the cathode with respect to the second Wehnelt electrode can be made. Therefore, even in cases in which the emitter, which is a constituent element of the cathode, can be very small in shape, and the emitter must be placed at a position within an exact permissible tolerance range with respect to the second Wehnelt electrode, the emitter can be easily and reliably placed at the desired position.

In the electron gun according to the present invention, the opening area of the first aperture of the first Wehnelt electrode can be larger than the opening area of the second aperture of the second Wehnelt electrode. Through this configuration, control of the direction of the electrons emitted from the cathode can be performed in a reliable fashion by the first Wehnelt electrode and the second Wehnelt electrode.

In the electron gun according to the present invention, the cathode can be configured to have a heater portion that radiates heat, and an emitter that is heated by the heater portion and that emits electrons. The emitter can be inserted into the second aperture of the second Wehnelt electrode.

This configuration is not one whereby the cathode is configured of a linear, coil-shaped filament, but rather one employing a so-called indirectly-heated type cathode. The heater portion can be formed of glassy carbon or the like, while the emitter can be formed of $LaB_6$, $CeB_6$, or the like. With an indirectly-heated type cathode, the heater current can be lower than with a linear, coil-shaped filament; also, the cathode can be swapped out in simple fashion, and high dimensional accuracy can be easily achieved.

In the electron gun according to the present invention, the electron emitting surface of the second Wehnelt electrode can be rectangular. The assembly can have an electrode shaft supporting member furnished to the second Wehnelt electrode on the opposite side from the electron emitting surface thereof, and electrode shafts supported by the electrode shaft supporting member and extending along the electron emitting surface. The emitter of the cathode can be disposed at a predetermined position with respect to the second aperture of the second Wehnelt electrode in a state in which the cathode is affixed to the electrode shafts. Through this configuration, the assembly can be given a stable structure in simple fashion.

In the electron gun according to the present invention, the cathode can be affixed by screws to one end of the electrode shafts. Terminal blocks can be furnished to the other end of the electrode shafts, and a terminal of a power supply system detachably connected to the terminal blocks.

Through this configuration, the electron gun can be formed to smaller scale, and moreover the configuration for receiving electrical power (specifically, voltage and current) can be given a small-scaled, stable structure.

The electron gun according to the present invention can have a Wehnelt cover for covering the assembly and the first Wehnelt electrode, and an attachment portion affixed to the Wehnelt cover. The attachment portion is attached to another member (for example, to a base) and disposed at a predetermined position. Through this configuration, the assembly is easily handled by the operator.

Next, the X-ray generator according to the present invention is an X-ray generator having an electron gun, and an anti-cathode in opposition thereto, wherein the electron gun is an electron gun of any of the configurations disclosed above, the electron gun being detachably attached to the anti-cathode in a predetermined position.

According to this X-ray generator, replacement of the electron gun and replacement of the cathode within the electron gun can be easily performed, and moreover the cathode, which is a constituent element of the electron gun, can always be placed reliably at the desired position within the X-ray generator.

Next, the X-ray measurement apparatus according to the present invention is an X-ray measurement apparatus for irradiating a sample with X-rays generated by an X-ray generator, and detecting with an X-ray detector X-rays generated by the sample, wherein the X-ray generator is the X-ray generator of the afore-described configuration.

According to this X-ray measurement apparatus, replacement of the electron gun, which is a constituent element of the X-ray generator, and replacement of the cathode within the electron gun, can be easily performed; and moreover the cathode, which is a constituent element of the electron gun, can always be placed reliably at the desired position within the X-ray generator. Therefore, in cases in which it is required to perform multiple types of measurements employing different types of X-rays, the requirement can be met.

EFFECT OF THE INVENTION

According to the present invention, the assembly that includes the cathode and the second Wehnelt electrode is detachably attached to the first Wehnelt electrode. Then, with the assembly having been assembled into a single body, position adjustments of the cathode with respect to the second Wehnelt electrode can be made. Therefore, the emitter, which is a constituent element of the cathode, can be very small in shape, and even in cases in which the emitter must be placed at a position within an exact permissible tolerance range with respect to the second Wehnelt electrode, the emitter can be easily and reliably placed at the desired position.

DESCRIPTION OF THE PREFERRED EMBODIMENTS

Figure 1:
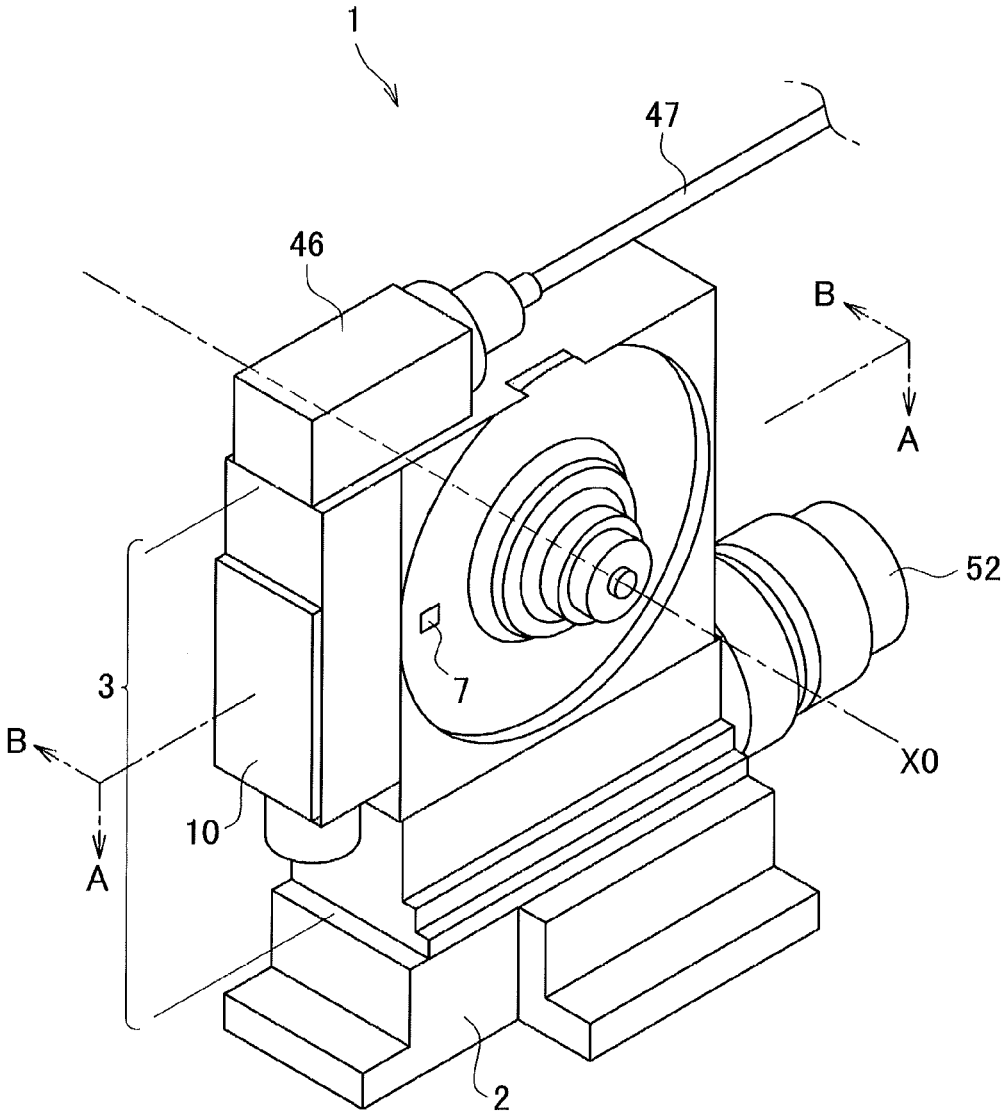
FIG. 1 is a perspective view showing an embodiment of the X-ray generator according to the present invention.

The X-ray generator according to the present invention is described below on the basis of the preferred embodiments. As shall be apparent, the present invention is not limited to these embodiments. The drawings are referred to in the following description, but constituent elements are sometimes shown in the drawings at a scale other than the actual scale, in order to facilitate understanding of characteristic portions.

(OverallConfiguration of X-ray Generator)

Figure 2:
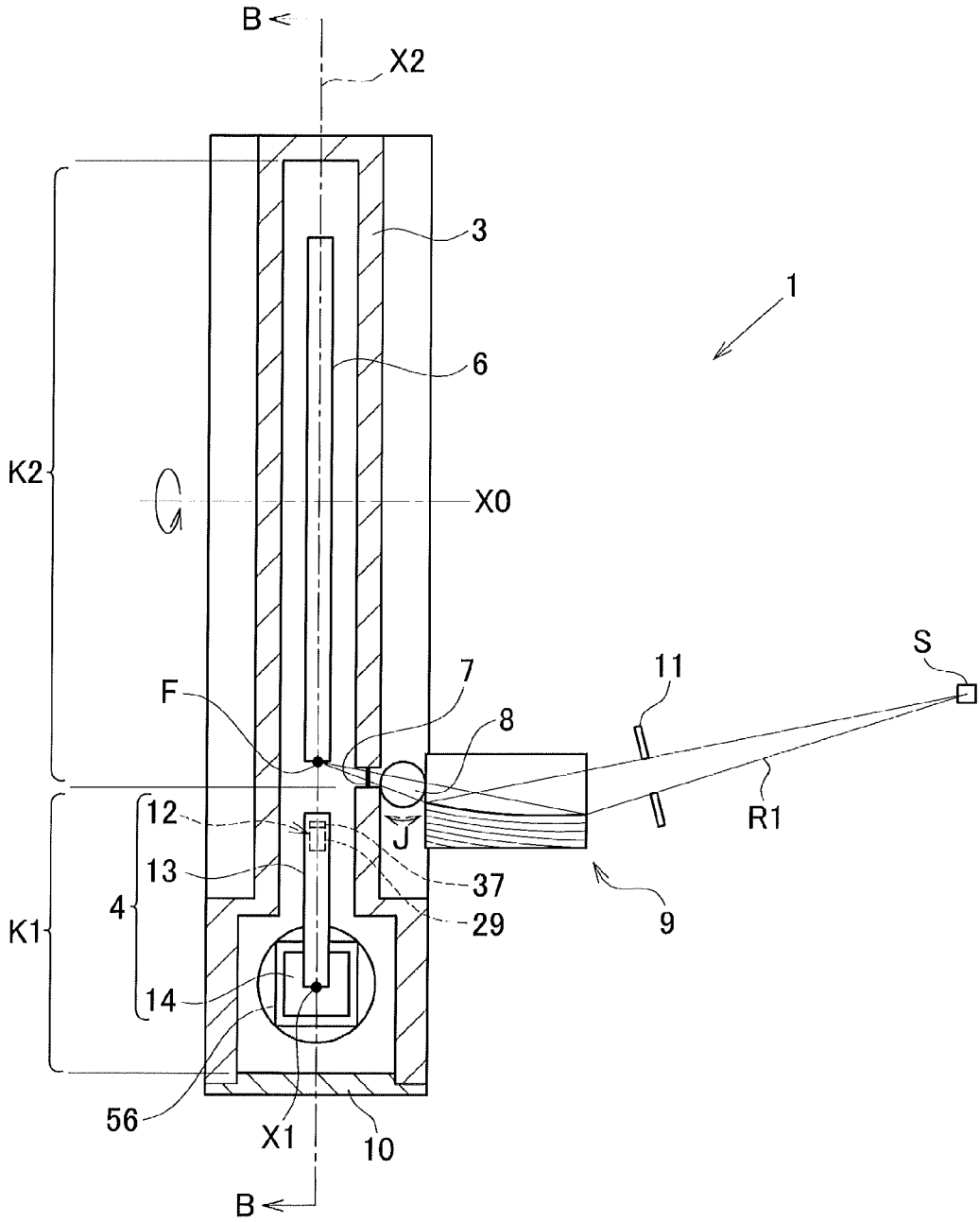
FIG. 2 is a sectional plan view taken along line A-A in FIG. 1.
Figure 3:
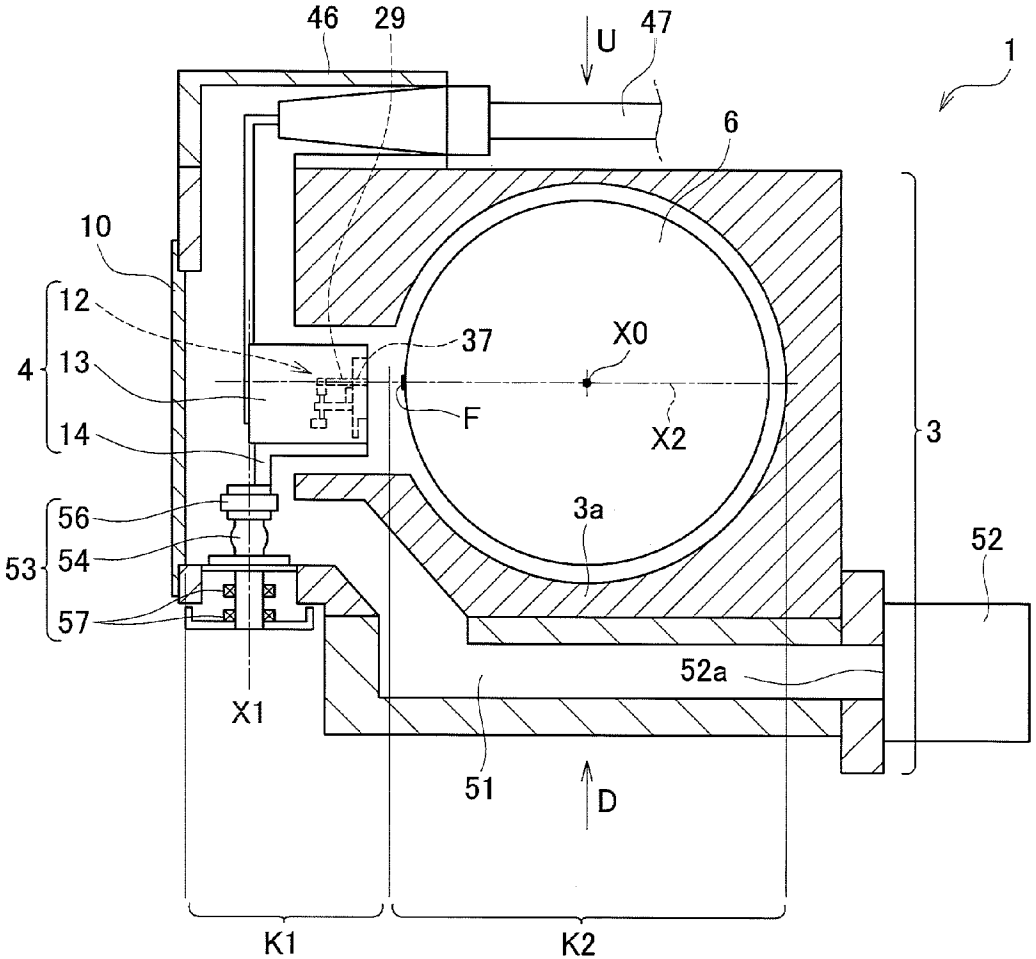
FIG. 3 is a sectional longitudinal view taken along line B-B in FIG. 1 and FIG. 2.
Figure 4:
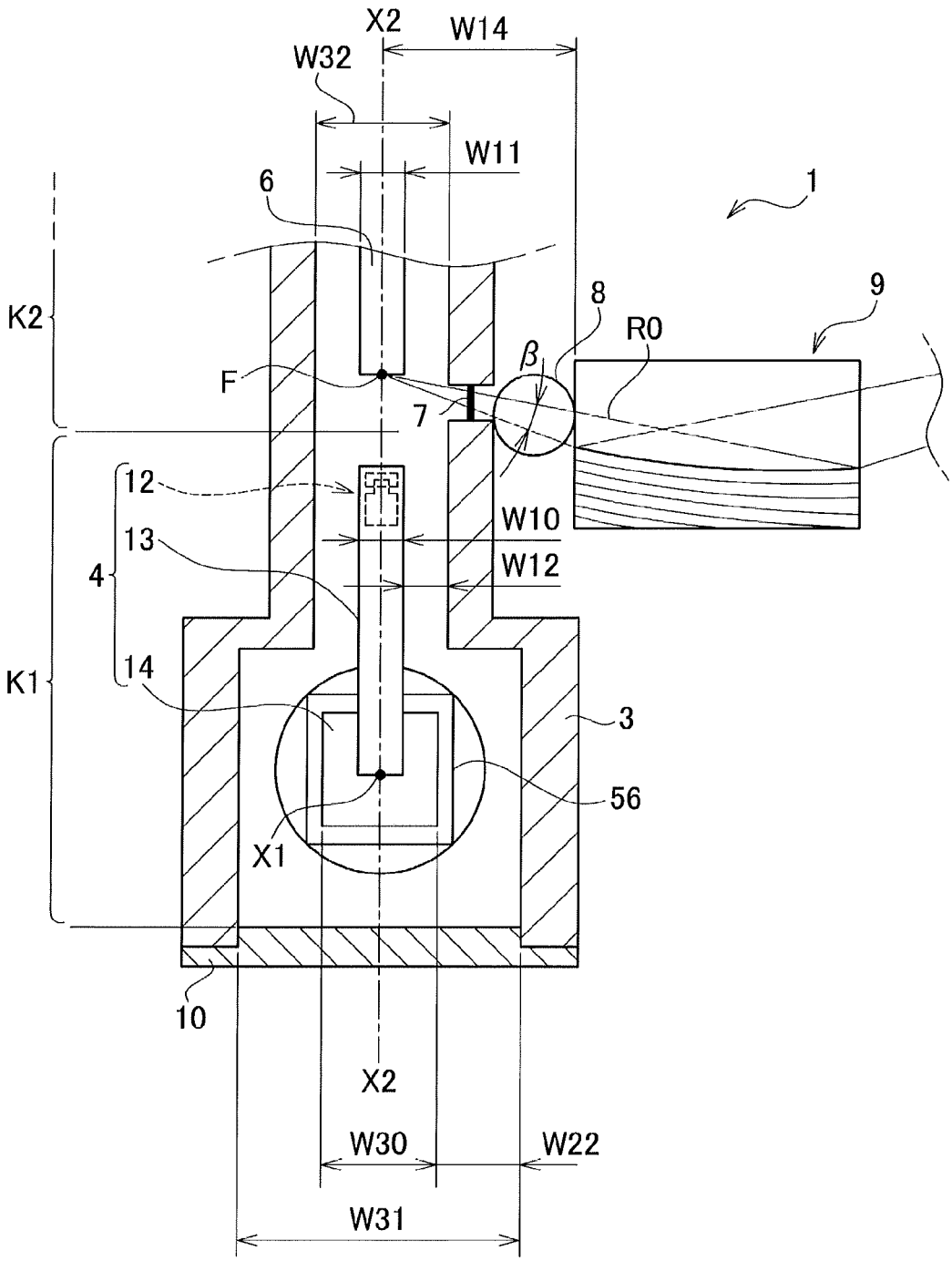
FIG. 4 is a sectional plan view showing an enlargement of the main part in FIG. 2.

FIG. 1 is a perspective view showing the exterior of the X-ray generator according to the present invention. FIG. 2 is a sectional plan view taken along line A-A in FIG. 1. FIG. 3 is a sectional longitudinal view taken along line B-B in FIG. 1 and FIG. 2. FIG. 4 is a view showing an enlargement of the main part in FIG. 2.

In the figures, an X-ray generator 1 has a pedestal 2 (shown in FIG. 1), a casing 3 made of metal furnished on the pedestal 2, an electron gun 4 furnished inside the casing 3, and a rotating anode 6 likewise furnished inside the casing 3 in opposition to the electron gun 4. Illustration of the pedestal 2 has been omitted in FIGS. 2 and 3. The electron gun 4 is disposed within a cathode housing space K1 within the casing 3. The rotating anode 6 is disposed within an anti-cathode housing space K2 within the casing 3. The cathode housing space K1 and the anti-cathode housing space K2 are spaces that connect to one another.

In FIG. 2, an X-ray extraction window 7 is furnished to a section of the wall of the casing 3 in the section thereof where the electron gun 4 and the rotating anode 6 are in opposition. The X-ray extraction window 7 is formed by a material through which X-rays can pass, for example, beryllium (Be). The end portion of the casing 3 on the side at which the electron gun 4 is disposed constitutes an opening of a size such that the electron gun 4 can be passed in and out there-through. The opening is closed off by a lid 10. The lid 10 is detachably attached to the casing 3 by a screw or other such fastening means.

While FIG. 2 shows an example in which the X-ray extraction window 7 is furnished to the wall on the right side of the casing 3 (the wall to the front side, not illustrated in FIG. 3), the X-ray extraction window 7 could be furnished to the wall on the left side of the casing 3 (the wall to the back side in FIG. 3) as well. The X-ray extraction window 7 could also be furnished to the front side and/or the back side in FIG. 2 (specifically, the upper side U and/or the lower side D of the X-ray generator 1 shown in FIG. 3).

The X-ray generator 1 in FIG. 2 also has an X-ray shutter 8 furnished in proximity to the outside of the X-ray extraction window 7; a monochromator 9 equipped with a light-focusing functionality, as an X-ray conditioning element furnished at the rear part (right-side part in FIG. 2) of the X-ray shutter 8; and a slit 11 for blocking the advance of unnecessary X-rays. As shown in FIG. 4, the X-ray extraction window 7 has an irradiation angle that is wider than the range of angle β within which the monochromator 9 captures the X-rays generated from the X-ray focus F. An X-ray conditioning structure other than a monochromator may also be used as the X-ray conditioning element. Illustration of the X-ray shutter 8 and the monochromator 9 is omitted in FIG. 1.

In a case in which the X-ray generator 1 is applied in an X-ray measurement apparatus, specifically, in an X-ray analysis apparatus, in FIG. 2, the X-rays that have passed through the slit 11 irradiate an extremely small region (for example, a region within the range of 50×50 μm to 150×150 μm) of a sample S, e.g., a protein. In the case that the sample S causes diffraction, the diffracted rays are detected by an X-ray detector, not shown in the figures. The X-ray measurement apparatus is not limited to a specific configuration, and the present invention may be applied in an apparatus for measuring diffraction by a focusing method, an apparatus for measuring diffraction by a parallel beam method, or various other types of X-ray measurement apparatus. Illustration of the slit 11 and the sample S is omitted in FIG. 1.

(Electron Gun)

Figure 5:
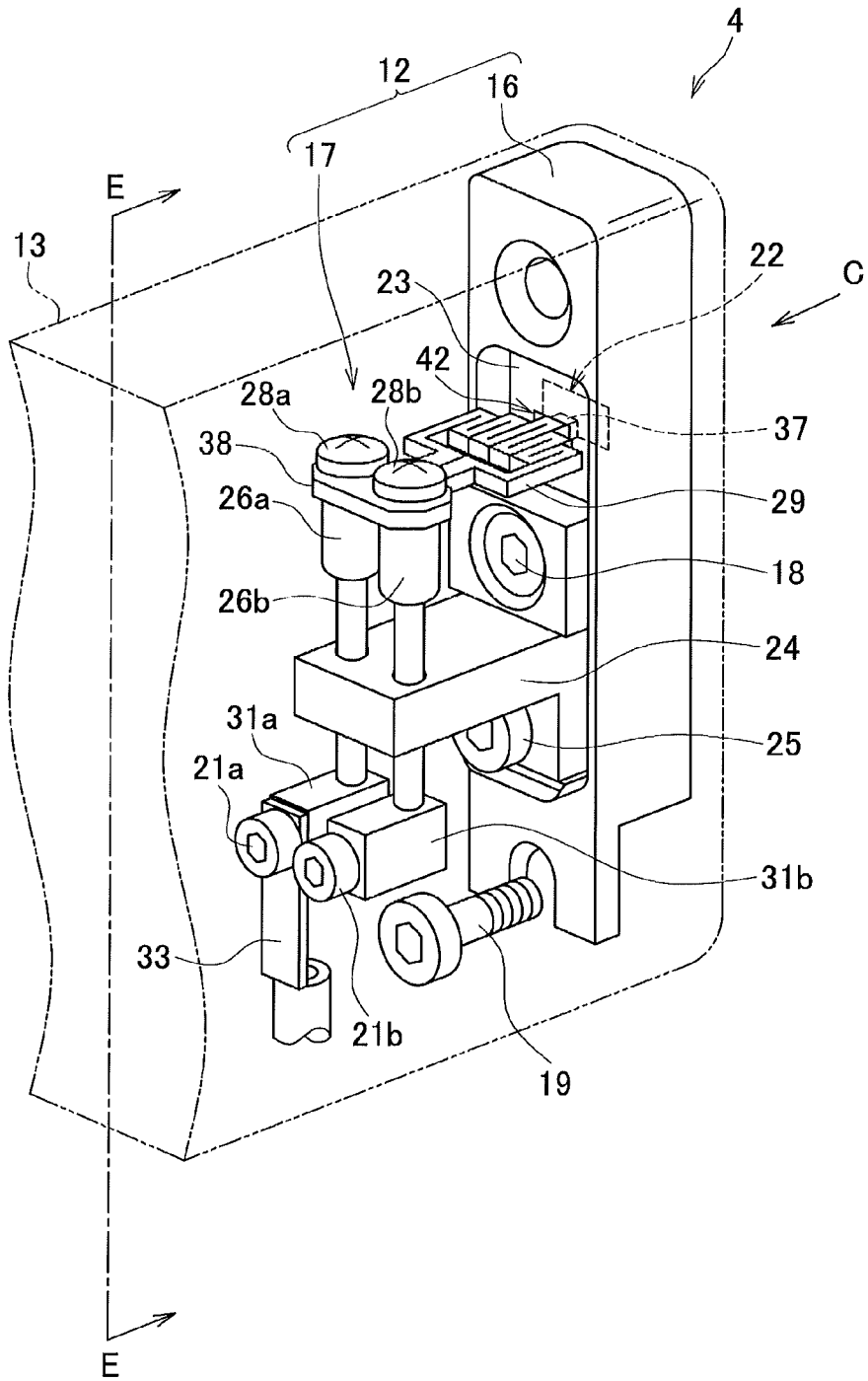
FIG. 5 is a perspective view showing an embodiment of the electron gun according to the present invention.

The electron gun 4 in FIGS. 3 and 4 has an electron generating portion 12, a Wehnelt cover 13, and an attachment portion 14 integrated with the Wehnelt cover 13. As shown in FIG. 5, the electron generating portion 12 has a first Wehnelt electrode 16 and a cathode unit 17. The cathode unit 17 is affixed to the first Wehnelt electrode 16 by a screw 18 (for example, a hexagonal-apertured bolt 2.6 mm in diameter). The first Wehnelt electrode 16 is affixed to the Wehnelt cover 13 by a screw 19 (for example, a hexagonal-apertured bolt 2.6 mm in diameter).

Figure 6:
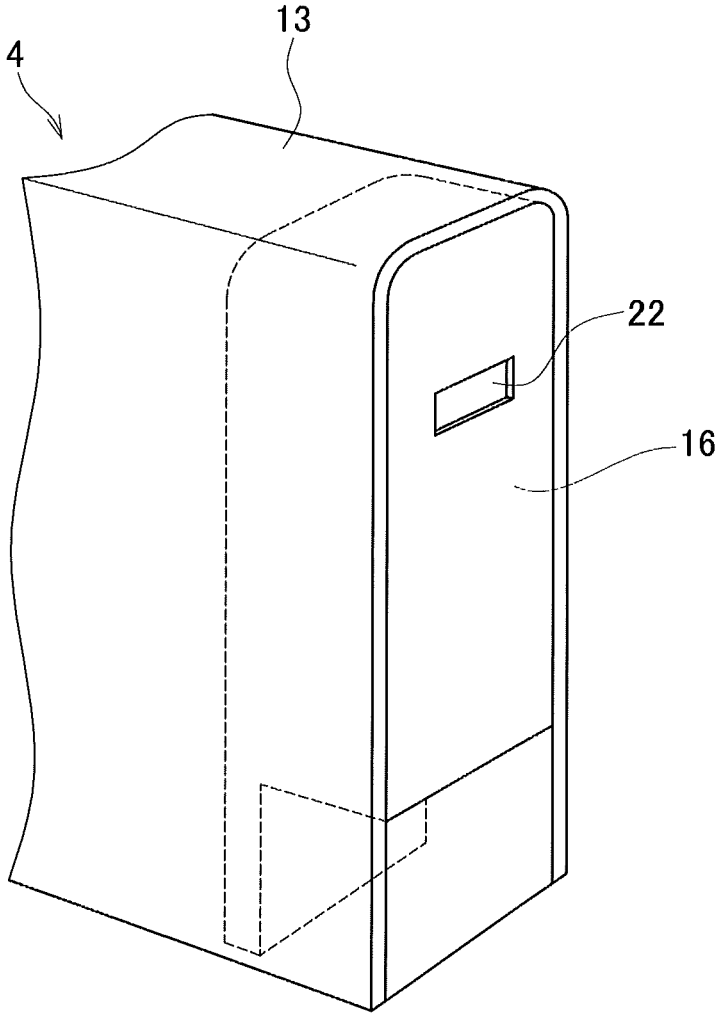
FIG. 6 is a perspective view showing the anterior surface of the electron gun taken along of arrow C in FIG. 5.

The surface of the first Wehnelt electrode 16 opposing the rotating anode 6 is as shown in FIG. 6, taken along arrow C. In FIG. 6, the Wehnelt cover 13 covers a section of the first Wehnelt electrode 16 excluding the surface thereof opposing the rotating anode 6. The first Wehnelt electrode 16 has a first aperture 22 which is an aperture through which electrons are allowed to pass.

Figure 7:
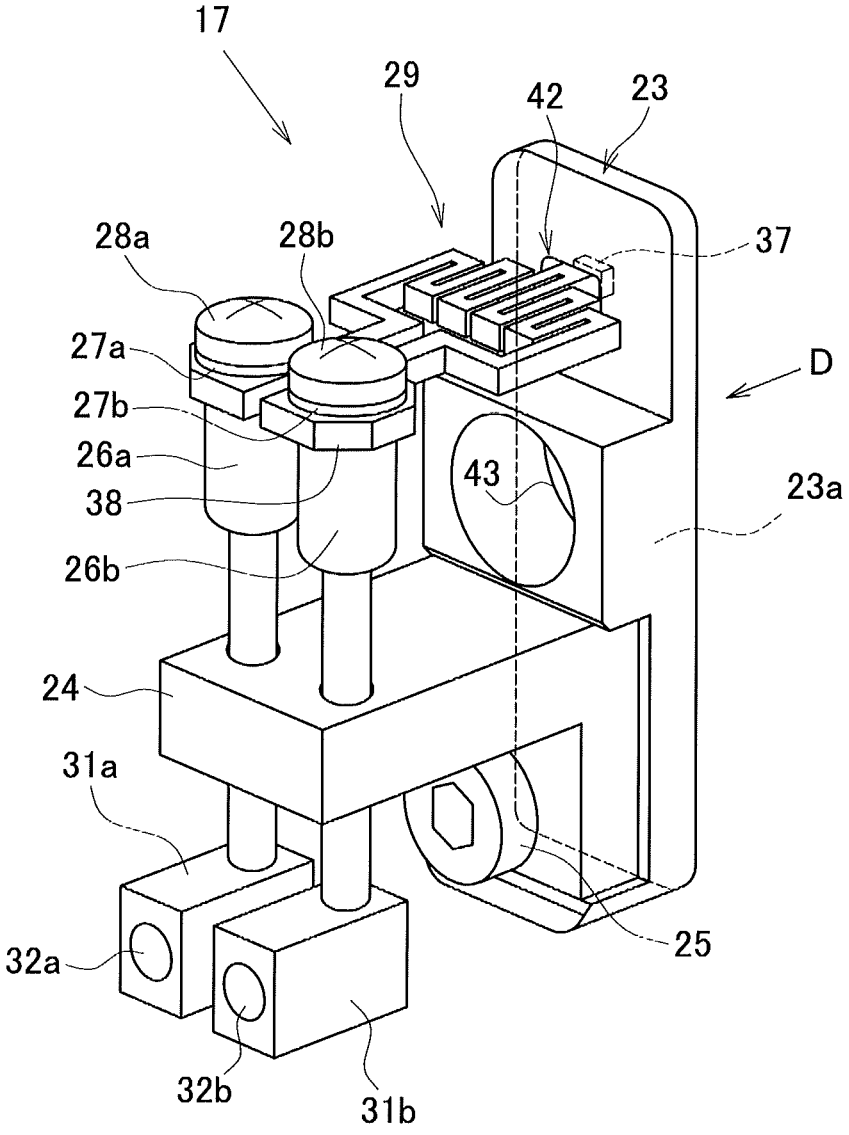
FIG. 7 is a perspective view showing the cathode unit which is the main part of the electron gun shown in FIG. 7.

In the present embodiment, the cathode unit 17 is configured to detachably attach to the first Wehnelt electrode 16. FIG. 7 shows the single cathode unit 17 detached from the first Wehnelt electrode 16. The cathode unit 17 has a second Wehnelt electrode 23, a bracket 24 constituting an electrode shaft support member of L-shaped cross section affixed to the back surface thereof, two electrode shafts 26*a*, 26*b* passing through the bracket 24, and a cathode 29 affixed to the upper ends of the electrode shafts 26*a*, 26*b* by screws 28*a*, 28*b*, with carbon washers 27*a*, 27*b* therebetween.

The bracket 24 is affixed to the back surface of the second Wehnelt electrode 23 by a screw (for example, a hexagonal-apertured bolt) 25. The bracket 24 and the electrode shafts 26*a*, 26*b* are joined to one another by a heat-resistant adhesive. Terminal blocks 31*a*, 31*b* are joined by welding (for example, by TIG welding (Tungsten Inert Gas welding)) to the bottom ends of the electrode shafts 26*a*, 26*b*. Each terminal block 31*a*, 31*b* is furnished with a screw hole 32*a*, 32*b*. Terminal screws 21*a*, 21*b* (FIG. 5) can be screwed into these screw holes 32*a*, 32*b*.

In FIG. 5, a terminal 33 of an external electrical system is introduced through the lower portion of the Wehnelt cover 13. Either the terminal block 31*a* or 31*b*, or both, can be electrically connected to another electrical system by joining the corresponding terminal 33 to the terminal block 31*a* or 31*b* by the terminal screw 21*a* or 21*b*. In the present embodiment, the external terminal 33 is connected to one terminal block 31*a*.

The terminal blocks 31*a*, 31*b* are formed of a conductive material, for example, SUS 304. The electrode shafts 26*a*, 26*b* are formed of a conductive material, for example, SUS 304. The bracket 24 is formed of an insulating material, for example, a ceramic. The first Wehnelt electrode 16 and the second Wehnelt electrode 23 are formed of a conductive material, for example, SUS 304.

In the present embodiment, when the terminal screw 21*a* or 21*b* at the bottom portion of the electron generating portion 12 in the state shown in FIG. 5 is loosened and detached, and furthermore the screw 18 loosened and detached, the cathode unit 17 can then be detached from the first Wehnelt electrode 16. By reversing this procedure, the cathode unit 17 can be attached to the first Wehnelt electrode 16.

Figure 8:
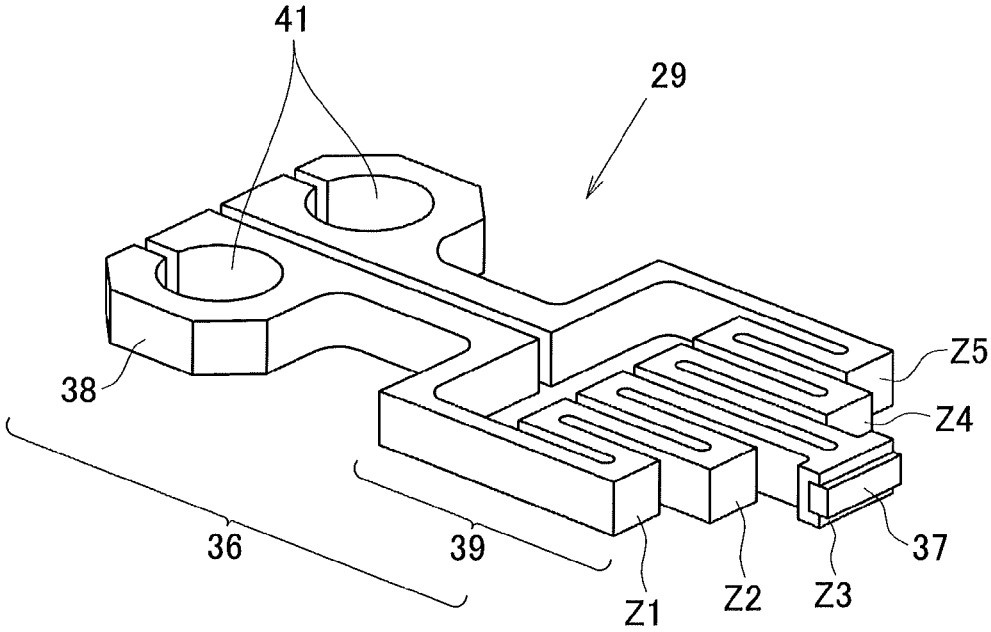
FIG. 8 is a perspective view showing the cathode which is the main part of the cathode unit shown in FIG. 7.

As shown in FIG. 8, the cathode 29 is formed by a heater portion 36 formed of amorphous carbon, and an emitter (electron emitting body) 37 formed of a single crystalline boride or sintered polycrystalline boride. The amorphous carbon is a glassy carbon, for example. The boride is, for example, $LaB_6$ (lanthanum hexaboride), $CeB_6$ (cerium hexaboride), or the like.

The heater portion 36 has an attachment portion 38 constituting the section that is affixed to the electrode shafts 26*a*, 26*b* in FIG. 7, and a meandering portion 39 that meanders in order to effectively generate heat. The emitter 37 is joined to the distal end portion at the center of the heater 36 by an adhesive, preferably a carbon adhesive. Through-holes 41 for passage of the screws 28*a*, 28*b* of FIG. 7 are formed in the attachment portion 38.

As the shape of the cathode 29, an appropriate shape other than that shown in FIG. 8 can be selected, depending on the supplied current, and the amount of heat radiation required.

Figure 9:
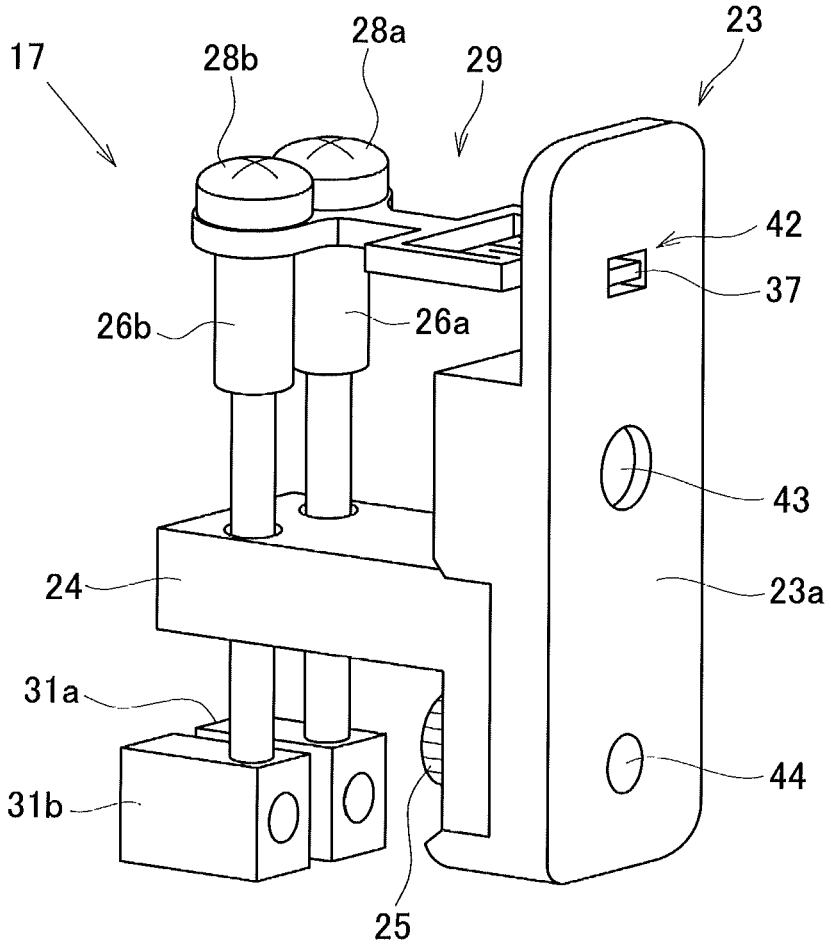
FIG. 9 is a perspective view showing the anterior surface of the cathode unit taken along arrow D in FIG. 5.

In FIG. 7, the surface of the second Wehnelt electrode 23 opposing the rotating anode 6 is as shown in FIG. 9, taken along arrow D. In FIG. 9, the surface of the second Wehnelt electrode 23 from which electrons are emitted (hereinafter termed the electron emitting surface) 23*a* is formed to approximately rectangular shape. The second Wehnelt electrode 23 is furnished, in order from the top, with a second aperture 42 which is an aperture for housing the emitter 37 of the cathode 29, a through-hole 43 for passage of the screw 18 in FIG. 5 (screw for joining to the first Wehnelt electrode 16), and a screw hole 44 for engaging the screw 25 (screw for affixing the bracket 24).

Figure 10:
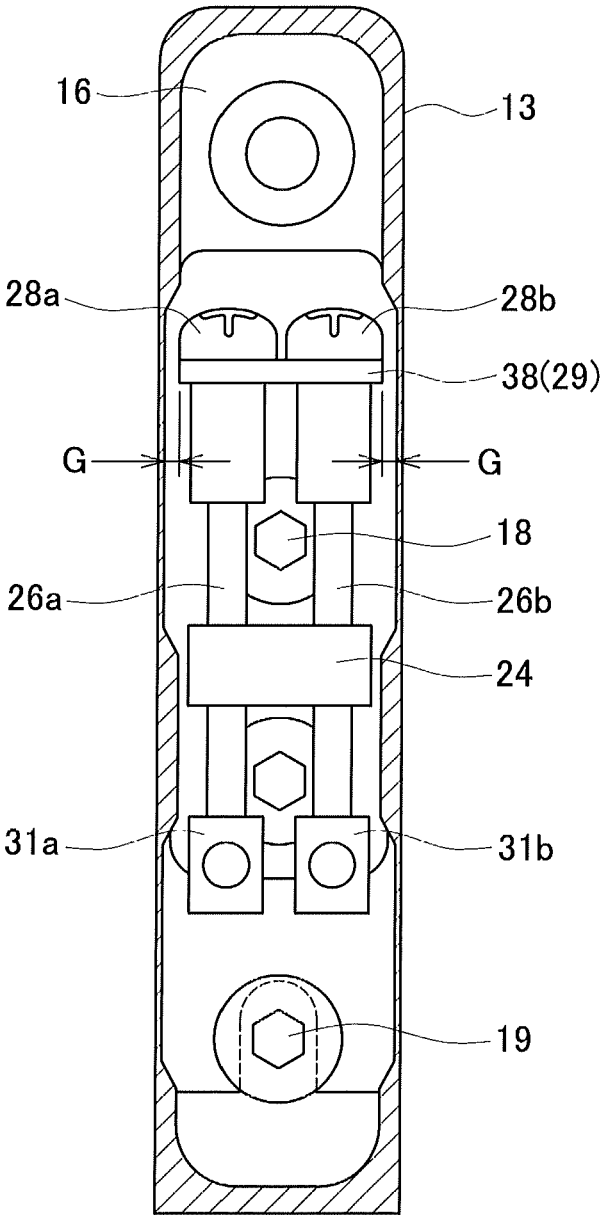
FIG. 10 is a sectional longitudinal view showing the sectional structure of the electron gun taken along line E-E in FIG. 5.

The cross-sectional structure of the electron gun 4, taken along line E-E in FIG. 5, is as shown in FIG. 10. In FIG. 10, the gap G between the attachment portion 38 of the cathode 29 and the inside surface of the Wehnelt cover 13 is about 0.75 mm, for example.

Figure 11B:
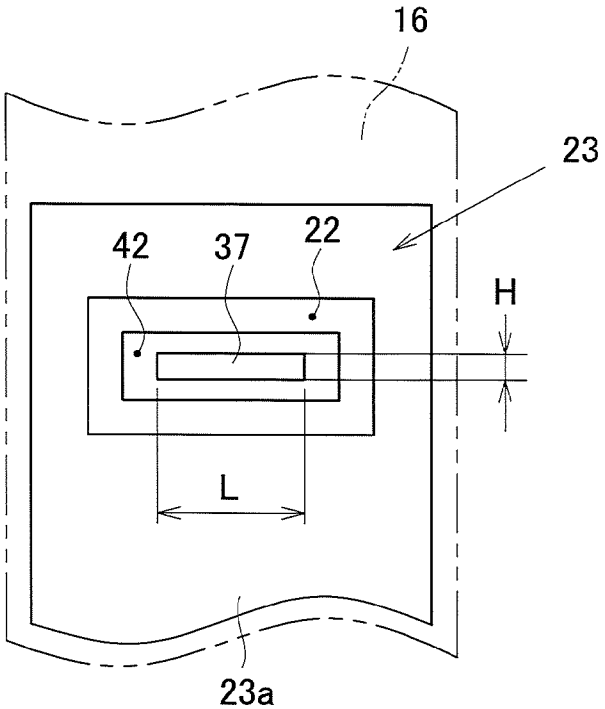
FIG. 11B is a front view of the emitter.
Figure 11A:
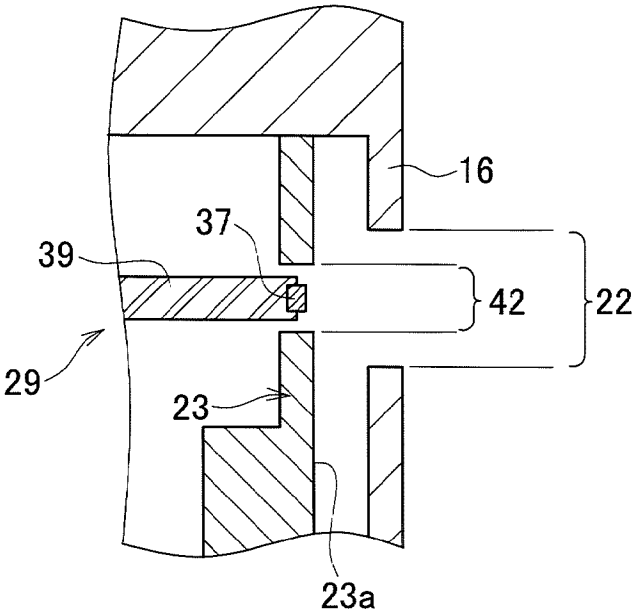
FIG. 11A is a sectional longitudinal view showing the cathode emitter which is the main part in FIG. 5, and the surrounding area thereof.

FIGS. 11A and 11B show positional relationships among the emitter 37 of the cathode 29, the second Wehnelt electrode 23, and the first Wehnelt electrode 16. FIG. 11A is a side sectional view, and FIG. 11B is a front view. The height H and length L of the electron emitting surface of the emitter 37 are H×L=0.5 mm×2 mm, for example. With the cathode unit 17 attached to the first Wehnelt electrode 16 as shown in FIG. 5, the relative position of the electron emitting surface 23*a* (hereinafter also called the reference surface), which is the surface of the second Wehnelt electrode 23 on the side towards the rotating anode 6 (see FIG. 3), is positioned automatically and reliably at a predetermined position.

The relative position of the emitter 37 with respect to the electron emitting surface of the second Wehnelt electrode 23, specifically, the reference surface 23*a*, is adjusted by loosening and tightening the screws 28*a*, 28*b* in FIG. 7 and delicately moving the cathode 29, while checking the dimensions with a projector, or checking the dimensions with a non-contact height-measurement instrument that utilizes a laser beam. In specific terms, the dimensional tolerance of the emitter 37 with respect to the reference surface 23*a* is ±0.02 mm, for example. The parallelism of the emitter 37 with respect to the reference surface 23*a* is ±0.02 mm, for example.

Figure 16:
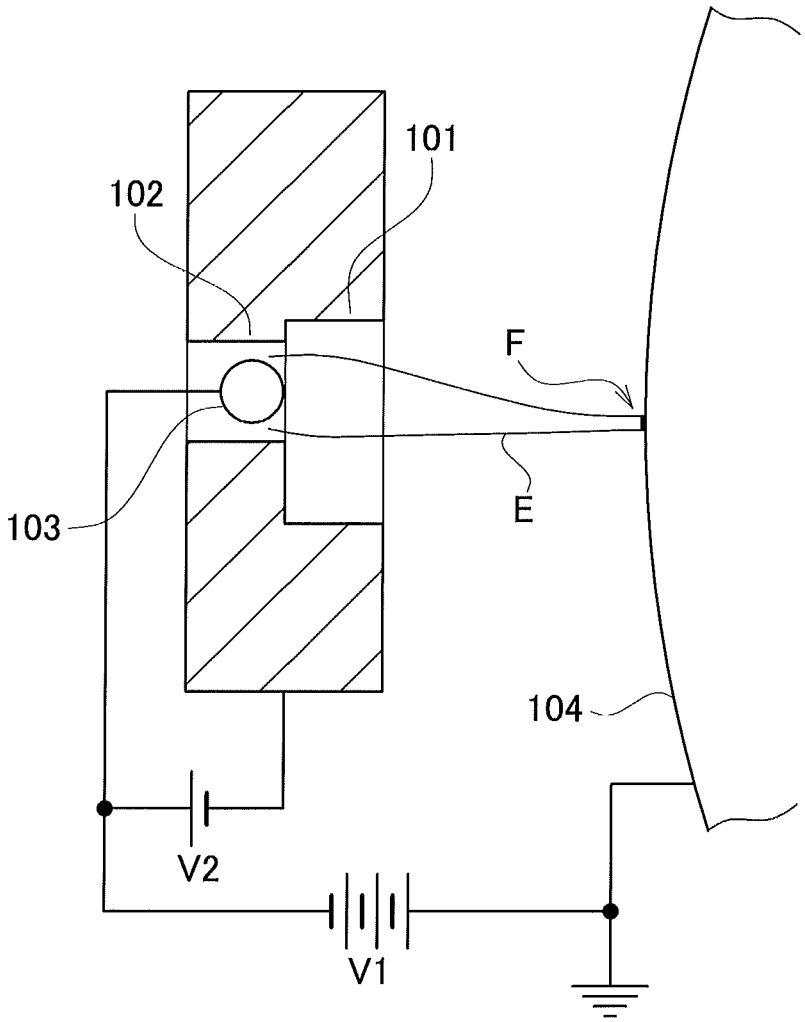
FIG. 16 (PRIOR ART)
FIG. 16 is a sectional side view showing the main part of an X-ray generator of the prior art.

In the present embodiment, the shape of the emitter 37 is very small, and furthermore, the relative position of the emitter 37 with respect to the reference surface 23*a* of the second Wehnelt electrode 23 must fall within a very exact tolerance range. In the prior art electron gun shown in FIG. 16, the first Wehnelt electrode 101 and the second Wehnelt electrode 102 are formed as a Wehnelt electrode that is a single integrated component, and this Wehnelt electrode is fixedly disposed in a non-detachable manner at a predetermined position on the anti-cathode 104. During adjustment of the relative position of the cathode 103 with respect to the Wehnelt electrodes 101, 102, the adjustment must be made by delicately moving the cathode 103 from the outside, with respect to the Wehnelt electrodes 101, 102 which have been affixed inside the X-ray generator. In a case in which the cathode 103 is of large size, or the tolerance range for the relative position of the cathode 103 with respect to the Wehnelt electrodes 101, 102 is wide, no problems are encountered when applying such a prior art adjustment method; however, in cases where, as in the present embodiment, the emitter 37 is very small in scale, and tolerance range for the relative position of the cathode 103 with respect to the Wehnelt electrodes 101, 102 is very small, satisfactory accuracy of position cannot be achieved with prior art adjustment methods such as the afore-described.

In relation to this point, in the present embodiment, the cathode unit 17, which includes the emitter 37 and the second Wehnelt electrode 23, is detachably attached to the first Wehnelt electrode 16. In the cathode unit 17 having been assembled into a single body, it is then possible to delicately adjust the position of the emitter 37 of the cathode 29 with respect to the reference surface 23*a* of the second Wehnelt electrode 23. As a result, even in a case in which the emitter 37 is very small in shape, and the emitter 37 must be placed at a position within an exact tolerance range with respect to the reference surface 23*a* of the second Wehnelt electrode 23, the emitter 37 can easily be placed at the desired position.

(Rotating Anode)

As will be understood from FIGS. 2 and 3, the rotating anode 6 is formed to disk shape. The outer peripheral surface of the rotating anode 6 is formed of a material that can generate X-rays of desired wavelength. For example, in a case in which CuKa rays are desired, it would be formed of copper (Cu). The outer peripheral surface of the rotating anode 6 could also be chromium (Cr) or tungsten (W).

The rotating anode 6, driven by a drive device, not illustrated, rotates about an axis X0 extending in the widthwise direction of the anti-cathode 6 itself (specifically, a direction orthogonal to the plane of the disk), rotating at a rotation speed of 9,000 to 12,000 rpm, for example. The drive device, not illustrated, may have any of a number of configurations, for example, a belt drive system in which the center shaft of the rotating anode 6 and a power supply are coupled by a belt, or a direct drive system in which rotation of the center shaft of the rotating anode 6 is driven directly by electromagnetic force. In cases of adopting driving methods of different systems, the shape of the casing 3 may change, but in any case, the interior space of the casing 3 for housing the rotating anode 6 is maintained in a hermetic state.

(Power System and Generation of X-rays)

In FIG. 3, a power supply portion 46 is furnished in the upper portion of the casing 3. A power cable 47 is connected to this power supply portion 46, with voltage and current being supplied through the power cable 47 from a high-voltage generating source, not shown, to the external terminal 33 of FIG. 5. The electron generating portion 12 of the electron gun 4 is thereby supplied with high voltage and high current.

Figure 12:
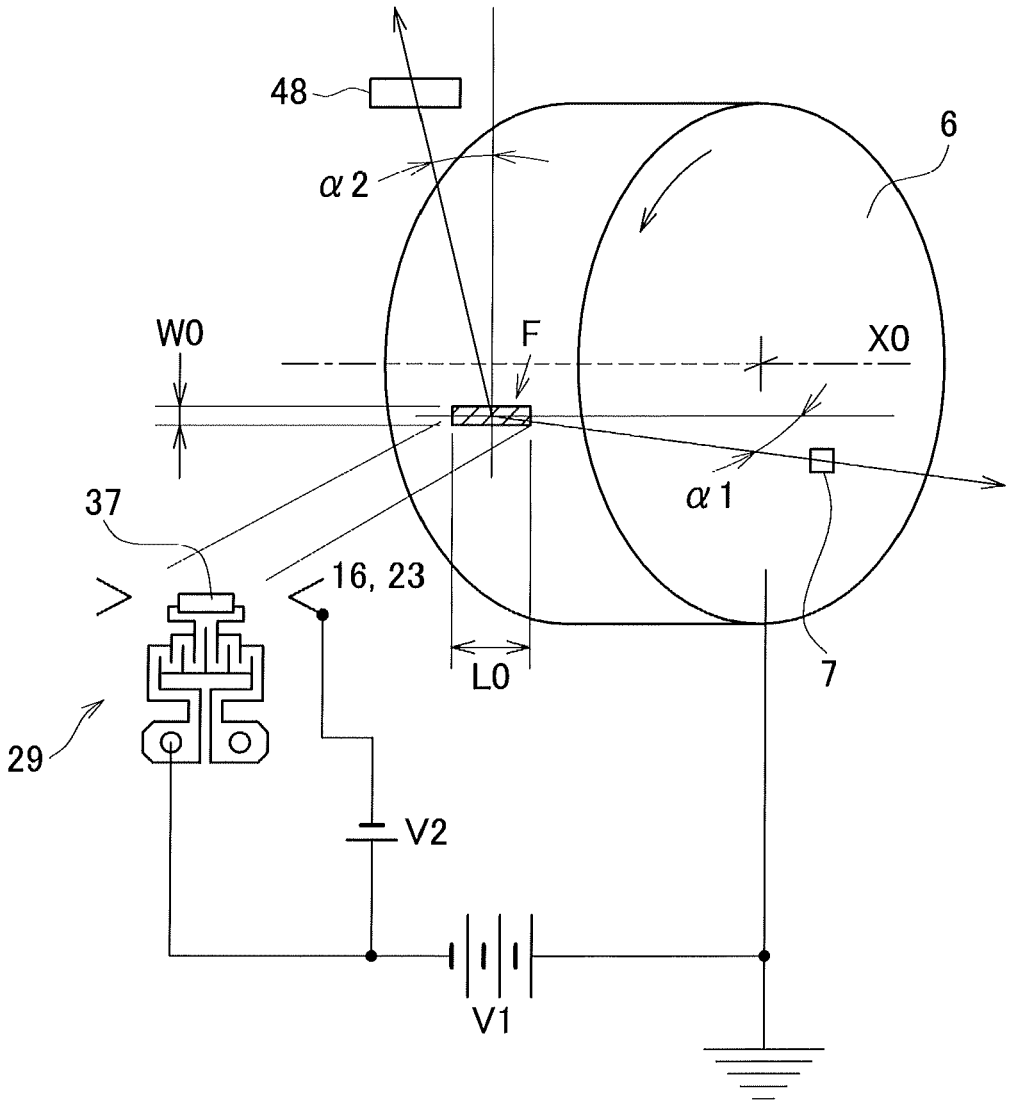
FIG. 12 is a diagram showing, in schematic form, generation of X-rays by a cathode and an anti-cathode.

FIG. 12 shows the cathode 29 and the rotating anode 6 in schematic form. In FIG. 12, the rotating anode 6 is electrically grounded. A negative voltage V1, for example, V1=45 to 60 kV, is applied across the rotating anode 6 and the cathode 29. A negative voltage V2, for example, V2=200 V, is applied across the cathode 29 and the first Wehnelt electrode 16, and across the cathode 29 and the second Wehnelt electrode 23. The voltages V1 and V2 are supplied through the power cable 47 of FIG. 3.

When energized, the cathode 29 radiates heat, and thermal electrons are emitted by the emitter 37. The emitted electrons, with the direction of advance thereof being controlled by the first Wehnelt electrode 16 and the second Wehnelt electrode 23, are accelerated by the voltage V1 and collide with the outer peripheral surface of the rotating anode 6. The region where the electrons collide with the outer peripheral surface of the rotating anode 6 is the X-ray focus F, and X-rays are generated in all directions in space from this X-ray focus F.

The actual X-ray focus F formed on the outer peripheral surface of the rotating anode 6 is called the real focus. The size of the real focus is, for example, a rectangular shape of width W0 and length L0, corresponding to the shape of the emitter 37 of the cathode 29. The dimensions are, for example, from a rectangular shape of W0=40 μm and L0=400 μm, to a rectangular shape of W0=70 μm and L0=700 μm.

X-rays emitted in all directions from the X-ray focus Fare extracted to the outside from the extraction window 7 which has been furnished in a parallel direction with respect to the rotation axis X0 of the rotating anode 6 (specifically, furnished at the short end side of the real focus F), or extracted to the outside from an extraction window 48 which has been furnished at a right angle with respect to the rotation axis X0 (specifically, furnished at the long end side of the real focus F). The angle α1 of the extraction window 7 with respect to the X-ray focus F, and the angle α2 of the extraction window 48 with respect to the X-ray focus F, are called the X-ray extraction angles; these angles are 5° to 6° , for example. The X-ray extraction window 7 is identical to the X-ray extraction window 7 shown in FIGS. 1 and 2. The X-ray extraction window 48 is not furnished in the present embodiment shown in FIGS. 1 and 2.

The X-ray focus of the X-rays extracted from the window 7 on the short end side of the real focus, and the X-ray focus of the X-rays extracted from the window 48 on the long end side of the real focus, is called the effective focus. When the real focus is 40×70 μm, the size of the effective focus of the X-rays extracted from the window 7 on the short end side of the real focus will be a 40×40 μm rectangular shape, or a 40 μm (diameter) circular shape; or when the real focus is 70×700 μm, will be 70×70 μm or 70 μm. X-rays extracted in this manner are called point focus X-rays.

When the real focus is 40×70 μm, the size of the effective focus of the X-rays extracted from the window 48 on the long end side of the real focus will be a 40×70 μm rectangular shape; or when the real focus is 70×700 μm, will be a 70×700 μm rectangular shape. X-rays extracted in this manner are called line focus X-rays.

Either point focus or line focus is selected for use appropriately, depending on the type of measurement being performed by the X-ray analysis apparatus, such as an X-ray diffractometer, an X-ray scattering apparatus, or the like. In the present embodiment, point focus X-rays are extracted from the single X-ray extraction window 7 on the short end side of the real focus.

(Evacuation System)

In FIG. 3, the electron gun 4 which includes the cathode 29 is housed within the cathode housing space K1 furnished within the casing 3. The rotating anode 6 is housed within the anti-cathode housing space K2 furnished within the casing 3. The cathode housing space K1 and the anti-cathode housing space K2 connect to one another. In order to prolong the life of the cathode 29, and to prevent soiling of the surface of the anti-cathode 6, the cathode housing space K1 and the anti-cathode housing space K2 are evacuated to a vacuum state, or to a reduced pressure state approaching a vacuum (hereinafter simply termed a vacuum state). The evacuation system is described below.

An evacuation passage 51 is furnished to the interior of the casing 3, at a location separated off by a wall 3*a* of the casing 3. One end of the evacuation passage 51 opens directly into the cathode housing space K1 housing the electron gun 4. Because the evacuation passage 51 is separated off by the wall 3*a*, it does not open directly into the anti-cathode housing space K2. A turbo-molecular pump 52 is connected as the evacuating means to the other end of the evacuation passage 51. The turbo-molecular pump 52 has a well-known configuration in which a plurality of rotating blades are attached to a rotating shaft in multiple stages along the center. While not illustrated in the drawings, a rotary pump is connected in a subsequent stage of the turbo-molecular pump 52.

The rotary pump serves as a primary evacuation apparatus for primary, rough pressure reduction of the cathode housing space K1 and the anti-cathode housing space K2, to a relatively high pressure that is below atmospheric pressure. The turbo-molecular pump 52 serves as a secondary evacuation apparatus for pressure reduction of the cathode housing space K1 and the anti-cathode housing space K2, to a state of pressure even lower than the primary pressure set by the rotary pump, and preferably to a vacuum state. An appropriate pump other than a rotary pump could be implemented by way of the primary evacuation apparatus for performing rough evacuation. Likewise, an appropriate pump other than a turbo-molecular pump, such as an oil-diffusion pump for example, may be implemented by way of the secondary evacuation apparatus for performing high-accuracy evacuation.

By setting the cathode housing space K1 and the anti-cathode housing space K2 to a vacuum state with the turbo-molecular pump 52 and the rotary pump, not illustrated, deterioration of the cathode 29 can be minimized, prolonging the life of the cathode 29. Furthermore, soiling of the surface of the anti-cathode 6 can be prevented, prolonging the life of rotating anode 6.

Typically, when electrons are generated from the emitter 37 of the cathode 29, generating X-rays from the X-ray focus F of the rotating anode 6, in addition to X-rays, secondary electrons (so-called recoil electrons) are generated from the X-ray focus F. When these secondary electrons advance to the interior of the turbo-molecular pump 52, charges accumulate within the turbo-molecular pump 52, posing the risk that abnormal discharge will be generated as a result. Moreover, the advancing electrons pose a risk of deterioration of the grease of the bearings supporting the rotating blades of the turbo-molecular pump.

In the present embodiment, however, the evacuation passage 51 which leads to the turbo-molecular pump 52 is isolated from the anti-cathode housing space K2 by the wall 3*a*, and therefore secondary electrons generated at the X-ray focus F of the anti-cathode 6 are extinguished within the anti-cathode housing space K2 without advancing into the evacuation passage 51, and consequently, advance of secondary electrons into the turbo-molecular pump 52 can be prevented.

In the present embodiment, the evacuation passage 51 extends in a direction at a right angle (the left-right direction in FIG. 3) with respect to the rotation axis X0 of the rotating anode 6. Moreover, the evacuation passage 51 is furnished on the same side as the rotating anode 6, as viewed from the cathode 29. Owing to this configuration, secondary electrons generated at the X-ray focus F can be reliably prevented from advancing into the evacuation passage 51, and the overall shape of the X-ray generator 1 can be formed at a very small scale, while still providing a structure in which the evacuation passage 51 is furnished at a separate location from the anti-cathode housing space R2.

Provided that the evacuation passage 51 is formed at a separate location from the anti-cathode housing space K2, it is not essential for the passage to be furnished in a direction extending at a right angle to the rotation axis X0 of the rotating anode 6, and generally parallel along a plane-parallel axis X2 of the rotating anode 6, as shown in FIG. 3; and extension of the passage in some other appropriate direction would also be acceptable.

(Electron Gun Support System)

In FIG. 3, a support device 53 for the electron gun 4 is furnished to an end portion of the casing 3. The support device 53 has an insulator 54 formed of a ceramic, and a pedestal 56 which is affixed onto the insulator 54. The attachment portion 14 of the electron gun 4 is affixed onto the pedestal 56 by a screw or other fastener. The electron gun 4, attached to another component besides the electron gun 4, is arranged at a predetermined position inside the X-ray generator 1, and in the present embodiment, the pedestal 56 functions as this other component. The attachment portion 14 may be affixed to the pedestal 56 with an affixing means other than a screw.

The insulator 54 is supported, in a manner rotatable about the axis X1 thereof, on the casing 3 by a bearing 57. The rotation axis X1 of the insulator 54, and hence of the pedestal 56, intersects the axis X2 pertaining to a widthwise direction of the rotating anode 6, which direction is orthogonal to the rotation axis X0 of the rotating anode 6; and specifically intersects the axis X2, which axis extends in a direction parallel to the plane of the disk of the rotating anode 6 (sometimes referred to as a plane-parallel axis), of the rotating anode 6.

The insulator 54 and the pedestal 56 affixed thereto are rotatable about the axis X1, but are usually fixed in the position shown in FIG. 2, specifically, a position at which the emitter 37 of the filament 29 of the electron gun 4 faces the rotating anode 6 head-on, specifically, a position at which the Wehnelt cover 13 defines a straight line with the plane-parallel axis X2 of the rotating anode 6.

By releasing the electron gun 4 from the afore-described affixed state, the pedestal 56 and the electron gun 4 attached thereto can undergo rotational movement, specifically, tilting movement, by a small angle about the axis X1. The pedestal 56 can then be affixed at its position subsequent to having undergone tilting movement. The purpose of such tilting movement of the electron gun 4 is to vary the region of collision of electrons with the outer peripheral surface of the rotating anode 6, specifically, the region for formation of the X-ray focus F, on the outer peripheral surface of the rotating anode 6. For example, having formed a section to the left side and a section to the right side of the center of the outer circumferential surface of the rotating anode 6 from mutually different materials, the wavelength of X-rays generated from the outer peripheral surface of the rotating anode 6 can be varied through tilting movement of the electron gun 4 in the left or right direction.

(X-ray Conditioning System)

Figure 13:
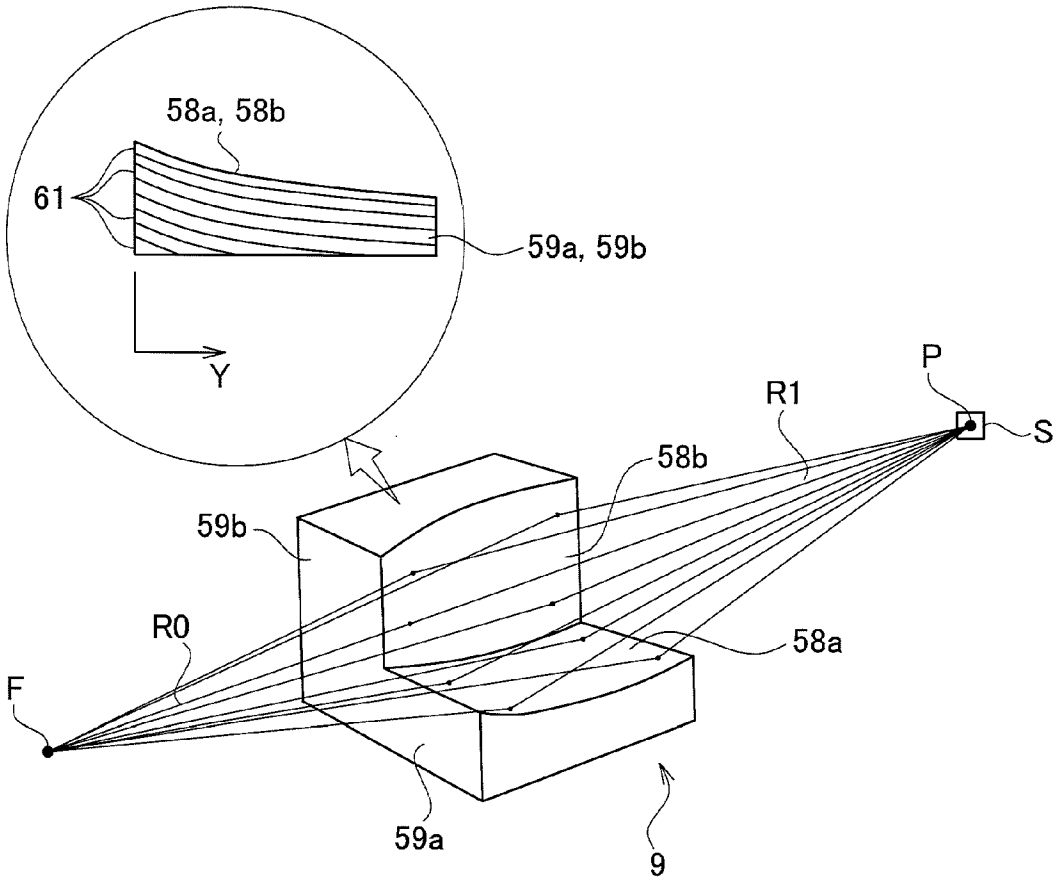
FIG. 13 is a perspective view showing a monochromator which is the main part in FIG. 2.

The monochromator 9 in FIG. 2 renders monochromatic the X-rays exiting the X-ray focus F, which include X-rays of several different wavelengths. Specifically, the monochromator 9 selectively extracts X-rays of specific wavelength from the X-rays of a plurality of several different wavelengths. In the present embodiment, the monochromator 9 is composed of a multilayer mirror of a so-called side-by-side structure. A Max-Flux (registered trademark) manufactured by Rigaku Corporation, for example, can be employed as the multilayer mirror. As shown in FIG. 13 for example, the side-by-side multilayer mirror is configured such that two multilayer mirrors 59*a*, 59*b* respectively having curved X-ray reflecting surfaces 58*a*, 58*b* are disposed at right angles to each other.

As shown schematically in the fragmentary view (a) of FIG. 13, the multilayer mirrors 59*a*, 59*b* are formed by alternating lamination of thin films 61 composed of a plurality of different materials. Materials including a laminated combination composed of two substances, such as Ni (nickel) and C (carbon), Mo (molybdenum) and Si (silicon), and W (tungsten) and $B_4C$, for example, can be applied in the thin films 61. In the fragmentary view (a) of FIG. 13, for the sake of convenience, the thin films 61 are depicted as being very thick, but actually the thin films 61 are very thin. The X-rays R0 exiting from the X-ray focus F are reflected (specifically, diffracted) by the X-ray reflecting surfaces 58*a*, 58*b*. The reflected X-rays R1 follow a path of advance that depends on the curved shape of the X-ray reflecting surfaces 58*a*, 58*b*.

For example, where the X-ray reflecting surfaces 58*a*, 58*b* are elliptical surfaces, and the X-ray focus F has been placed at one elliptical focus, the reflected X-rays R1 will be convergent X-rays that converge at the other elliptical focus. Where the X-ray reflecting surfaces 58*a*, 58*b* are parabolic surfaces, the reflected X-rays R1 will be parallel X-rays. In the present embodiment, the X-ray reflecting surfaces 58*a*, 58*b* are elliptical surfaces, set such that the reflected X-rays R1 converge at a position P at which a sample S is placed.

Typically, X-rays undergo diffraction when the Bragg diffraction condition $2d \sin \theta = n\lambda$ is satisfied. In the equation, "d" is the lattice spacing, "θ" is the Bragg angle (specifically, the incidence angle and reflection angle of X-rays), "n" is the order of reflection, and "λ" is the wavelength of X-rays used. The multilayer mirrors 59*a*, 59*b* have been designed such that, where "Y" is the distance from the side of X-ray incidence, the value of d varies each time the value of Y varies, with X-rays being reflected (specifically, diffracted) from each position of distance Y. High-intensity X-rays are thereby obtained as the reflected X-rays R1.

In FIG. 2, the X-ray shutter 8 furnished between the monochromator 9 serving as the X-ray conditioning element, and the X-ray extraction window 7 of the casing 3, is formed for example to have a cylindrical shape extending in the direction perpendicular to the page in FIG. 2 (direction passing through the page), and is further furnished with a through-hole for passage of X-rays in a direction crossing the axis of the cylindrical shape. X-rays are allowed to pass through, or the advance of X-rays is blocked, by aligning or de-aligning the through-hole with respect to the X-ray path of advance, by rotating the X-ray shutter 8 about its axis as shown by the arrow J.

(Dimensions of Casing, Electron Gun, and Other Components)

In the present embodiment, the shape and dimensions of the electron gun 4, the casing 3, and other components in FIG. 4 are set as follows. Dimensions are approximate values that include acceptable error.

Width W10 of the Wehnelt cover 13 of the electron gun 4: 10 mm,

Width W11 of rotating anode 6: 10 mm,

Distance W12 between the Wehnelt cover 13 of the electron gun 4 and the inside surface of the wall of the casing 3: 9.5 mm, Distance W22 between the attachment portion 14 of the electron gun 4 and the inside surface of the wall of the casing 3: 15 mm, Distance W14 from the axis X2 of the plane-parallel direction of the rotating anode 6 to the distal end of the monochromator 9 serving as the X-ray conditioning element: 30 mm.

The width W30 of the attachment portion 14 of the electron gun 4 is not so small that difficulties will arise when someone attaches or detaches the attachment portion 14 to and from the pedestal 56. The cathode housing space K1 is composed of a narrow section housing the electron generating portion 12 of the electron gun 4, and a wide section housing the attachment portion 14 of the electron gun 4. The width W31 of the wide section is sufficient for insertion of a person's finger. The width of the narrow section of the cathode housing space K1 is equal to the width W32 of the anti-cathode housing space K2.

The shape of the casing 3 can be modified in various ways, as needed. For example, the width of the narrow section of the cathode housing space K1 and the width W32 of the anti-cathode housing space K2 can be increased to equal the width of the width W31 of the wide section of the cathode housing space K1; or an equal uniform width may be adopted for the width of the entirety of the cathode housing space K1, and for the width of the anti-cathode housing space K2.

The width of the entirety of the cathode housing space K1, including the narrow section, in the present embodiment can be increased as shown by the reference symbol W31, eliminating the narrow section of the cathode housing space K1.

(Overall Operation of X-ray Generator)

By virtue of the foregoing configuration of the X-ray generator 1 of the present embodiment, the interior of the cathode housing space K1 and of the anti-cathode housing space K2 is set to a vacuum state, through operation of a venting device that includes the evacuation passage 51 and the turbo-molecular pump 52 of FIG. 3, and the rotary pump, not illustrated. Then, when the filament 29 is energized, the filament 29 radiates heat, and electrons 37 are emitted from the emitter 37. The emitted electrons, with the direction of advance thereof being controlled by the first Wehnelt electrode 16 and the second Wehnelt electrode 23 in FIG. 11, collide with the outside peripheral surface of the rotating anode 6 of FIG. 2, forming the X-ray focus F. X-rays are then emitted into space in all directions from this X-ray focus F.

When the X-ray shutter 8 has been set to a state permitting the passage of X-rays, the X-rays having passed through the X-ray shutter 8 impinge upon the X-ray reflecting surface of the monochromator 9. The X-rays impinging on the monochromator 9 are rendered monochromatic, and the monochromatic X-rays R1 converge in a region within the sample S. The slit 11 prevents unwanted X-rays from heading towards the sample S. The X-rays impinging on the sample S are diffracted in a manner corresponding to the crystalline structure of the sample S, and the diffracted rays are detected by an X-ray detector, not shown. The crystalline structure of the sample S can be analyzed through analysis of the detected results.

As the process of X-ray generation continues, the characteristics of the electron gun 4 increasingly deteriorate. In a case in which the characteristics have fallen below the allowable limit, the electron gun 4 is replaced. Moreover, in some cases, it becomes necessary to replace the electron gun 4 for one of a different type, depending on the type of measurement. During such replacement of the electron gun 4, the lid 10 at the side end of the casing 3 is detached from the casing 3, whereupon the operator inserts fingers into the cathode housing space K1, detaches the attachment portion 14 of the electron gun 4 from the pedestal 56, and then extracts the entire electron gun 4 out from the casing 3. Thereafter, another electron gun 4 is inserted into the cathode housing space K1, and the attachment portion 14 of the electron gun 4 is affixed to the pedestal 56, thereby arranging the electron gun 4 at a predetermined position with respect to the rotating anode 6.

In the X-ray generator 1 of the present embodiment, there are cases in which the cathode 29 shown in FIG. 5 must be replaced with another cathode. In such cases, the lid 10 furnished to the end face of the casing 3 shown in FIG. 3 is removed to reveal the opening. The operator then puts a hand through the opening, detaches the attachment portion 14 of the electron gun 4 from the pedestal 56, and then removes the electron gun 4 out from the casing 3.

Next, the removed electron gun 4 shown in FIG. 5 undergoes a procedure of loosening the terminal screw 21*a* and detaching the outside terminal 33 from the terminal block 31*a*, loosening the screw 18 and detaching the cathode unit 17 from the first Wehnelt electrode 16, and then removing the entire cathode unit 17 out from the Wehnelt cover 13. The first Wehnelt electrode 16 remains attached to the Wehnelt cover 13 by the screw 19 at this time.

With the removed cathode unit 17 in the state shown in FIG. 7, the screws 28*a*, 28*b* at the upper ends of the electrode shafts 26*a*, 26*b* in the cathode unit 17 are loosened and detached, and the cathode 29 is detached from the electrode shafts 26*a*, 26*b*. Next, the emitter 37 of another cathode 29 is inserted into the second aperture 42 of the second Wehnelt electrode 23, and the attachment portion 38 of the cathode 29 is affixed to the upper ends of the electrode shafts 26*a*, 26*b* by the screws 28*a*, 28*b*.

During this process, the emitter 37 is placed at the desired relative position with respect to the electron emitting surface 23*a* which is the reference surface of the second Wehnelt electrode 23. In the present embodiment, the emitter 37 is placed at a position accommodated within the second aperture 42 of the second Wehnelt electrode 23, as shown in FIGS. 11A and 11B. If necessary, the emitter 37 can be positioned such that a portion or the entirety thereof projects outside at the anti-cathode side (the right side in FIG. 11A) or to the outside in the opposite side from the anti-cathode side (the left side in FIG. 11A) from the second aperture 42.

Adjustments to the relative position of the emitter 37 with respect to the electron emitting surface 23*a* of the second Wehnelt electrode 23 are performed by loosening and tightening the screws 28*a*, 28*b* and appropriately moving the position of the cathode 29, while checking the dimensions with a projector, or checking the dimensions with a non-contact height-measurement instrument that utilizes a laser beam. These position adjustments are not performed within the Wehnelt cover 13 of FIGS. 3 and 5, but rather are performed outside the Wehnelt cover 13, after the cathode unit 17 has been separated from the first Wehnelt electrode 16. Consequently, with the present embodiment, even in a case in the emitter 37 is small in scale, and moreover the dimensional allowance required in relation to the position of arrangement of the emitter 37 is exacting, this requirement can be met.

(Modification Examples)

Figure 14:
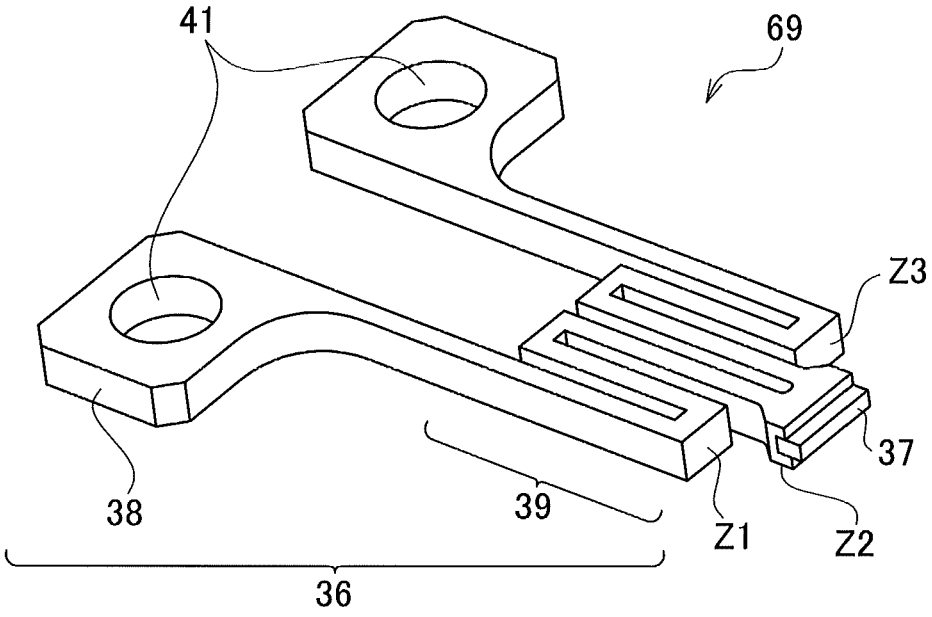
FIG. 14 is a perspective view showing a modification example of the cathode shown in FIG. 8.

The shape of the cathode 29 is not limited to the shape shown in FIG. 8; other shapes can be adopted if necessary. For example, in the embodiment of FIG. 8, the meandering portion 39 is formed from five meandering shapes Z1 to Z5, but the number of meandering shapes could be fewer or greater. FIG. 14 shows a cathode 69 according to a modification example. This cathode 69 possesses three meandering shapes Z1 to Z3. Identical members in FIG. 14 and FIG. 8 are shown by identical reference symbols.

Figure 15:
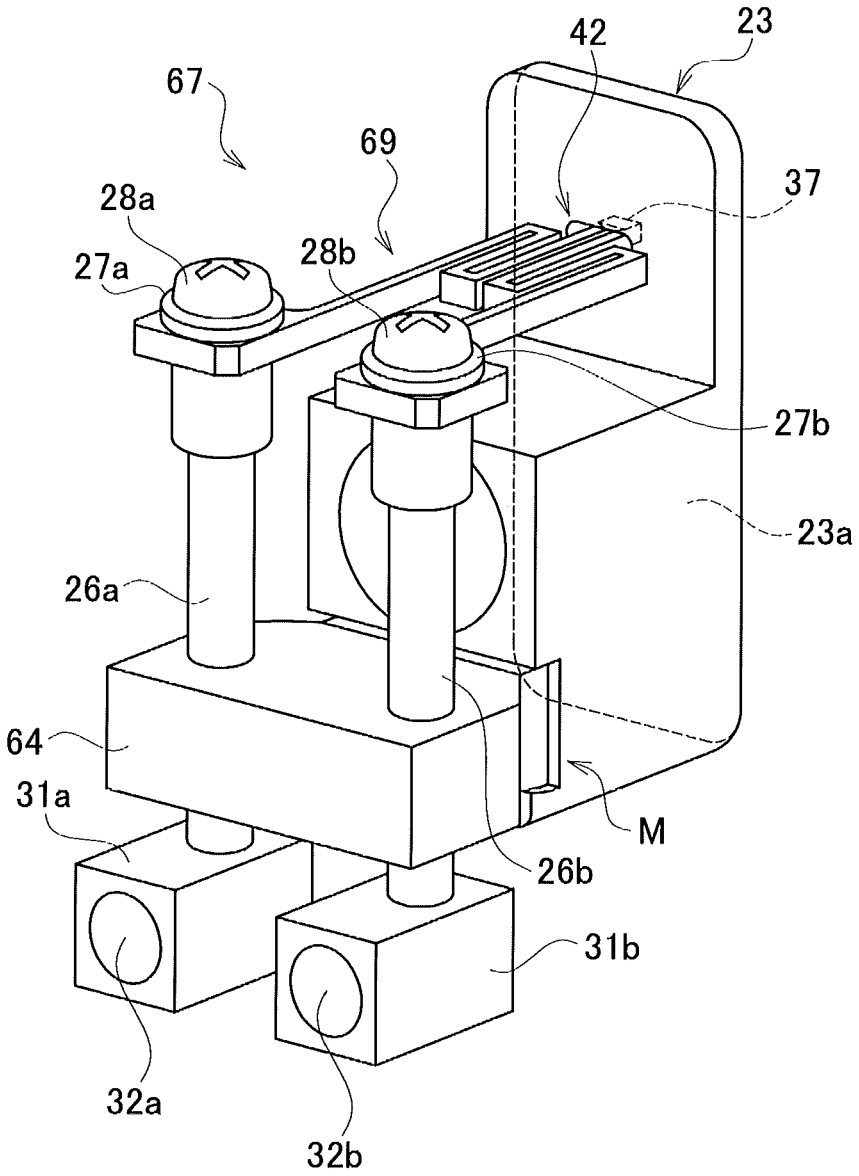
FIG. 15 is a perspective view showing a modification example of the cathode unit shown in FIG. 7.

FIG. 15 shows a cathode unit 67 configured using the afore-described cathode 69. The differences between this cathode unit 67 and the cathode unit 17 shown in FIG. 7 are:

(1) the bracket 64 serving as the electrode shaft support member for supporting the electrode shafts 26*a*, 26*b*, rather than being member of L-shaped cross section, is instead a member in the shape of a cuboid with chamfered edges; and (2) the second Wehnelt electrode 23, rather than being affixed to the bracket 64 by the screw 25 as shown in FIG. 7, is instead integrally joined thereto at the location of section M by welding. Identical members in FIG. 15 and FIG. 7 are shown by identical reference symbols.

(Other Embodiments)

The present invention has been described above using preferred embodiments, but the present invention is not limited by these embodiments and can be modified in various ways within the scope of the invention as recited in the claims.

For example, in the afore-described embodiment, the electron gun 4 in FIG. 2 can undergo tilting movement (specifically, rocking movement) about the center axis X1, but the present invention also encompasses a configuration in which the electron gun 4 is fixed in a state of always extending parallel to the center axis X2 that extends in the plane-parallel direction of the rotating anode 6, rather than undergoing tilting movement as described above.

In the afore-described embodiment, the rotating anode 6 is also used as the anti-cathode in the embodiments described above, but a fixed-type anti-cathode may also be used.

In the afore-described embodiment, the X-ray shutter 8 is furnished at an upstream position from the monochromator 9 along the direction of advance of X-rays, but the X-ray shutter 8 could instead be furnished at a downstream position from the monochromator 9. In so doing, the distance from the X-ray focus F to the monochromator 9 can be made shorter.

In the afore-described embodiment, rather than forming the cathode from a linear filament, the cathode is formed by forming the heater 36 from heat-radiating body of rectangular cross section having an appropriate meandering shape in the plane thereof, and joining the emitter 37 to the distal end of the heater portion 36. However, a linear filament of coil shape could be used for the cathode.

DESCRIPTION OF REFERENCE SYMBOLS

1. X-ray generator, 2. pedestal, 3. casing, 3*a*. wall, 4. electron gun, 6. rotating anode, 7. X-ray extraction window, 8. X-ray shutter, 9. monochromator, 10. lid, 11. slit, 12. electron generating portion, 13. Wehnelt cover, 14. attachment portion, 16. first Wehnelt electrode, 17. cathode unit(assembly), 18,19. screw, 21*a*,21*b*. terminal screw, 22. first aperture, 23. second Wehnelt electrode, 23*a*. electron emitting surface, 24. Bracket (electrode shaft support member), 25. screw, 26*a*, 26*b*. electrode shaft, 27*a*,27*b*. carbon washer, 28*a*,28*b*. screw, 29. cathode, 31*a*,31*b*. terminal block, 32*a*,32*b*. screw hole, 33. external terminal, 36. heater portion, 37. emitter, 38. attachment portion, 39. meandering portion, 41. through-hole, 42. second aperture, 43. through-hole, 44. screw hole, 46. power supply portion (power supply system), 47. power cable (power supply system), 48. extraction window, 51. evacuation passage, 52. turbo-molecular pump, 53. support device, 54. insulator, 56. Pedestal (another member), 57. bearing, 58*a*,58*b*. x-ray reflecting surface, 59*a*,59*b*. multilayer mirror, 61. thin film, 64. bracket (electrode shaft support member), 67. cathode unit, 69. cathode, F. X-ray focus, G. gap, H. height of emitter, J. direction of rotation, L. length of emitter, L0. length of X-ray focus, M. welding section, K1. cathode housing space, K2. anti-cathode housing space, R0,R1. X-rays, S. sample, V1,V2. voltage, W0. width of X-ray focus, W10. Width of Wehnelt cover, W11. Width W11 of rotating anode, W12. Distance between Wehnelt cover and casing, W22. Distance between attachment portion and casing, W14. Distance to monochromator, W30. width of attachment portion of electron gun, W31. width of cathode housing space, W32. width of anti-cathode housing space, X0. rotation axis of anode, X1. rotation axis of electron gun, X2. plane-parallel axis of anode, Y. distance of reflecting position of multilayer mirror, $\alpha$1,$\alpha$2. extracting angle, $\beta$. x-ray capturing angle of monochromator

What is claimed is:

1. An electron gun, comprising:

a cathode for emitting electrons;

a first Wehnelt electrode equipped with a first aperture through which electrons are allowed to pass; and a second Wehnelt electrode that is equipped with a second aperture disposed at a predetermined position with respect to the cathode and the first aperture, and that is furnished at a position closer to the cathode than the first Wehnelt electrode, wherein:

the cathode and the second Wehnelt electrode are included within a single assembly constituting a unitary body; and the assembly is detachably attached to the first Wehnelt electrode.

2. The electron gun according to claim 1, the opening area of the first aperture of the first Wehnelt electrode being larger than the opening area of the second aperture of the second Wehnelt electrode.

3. The electron gun according to claim 2, wherein the cathode has a heater portion that radiates heat, and an emitter that is heated by the heater portion and emits electrons, and the emitter is inserted into the second aperture of the second Wehnelt electrode.

4. The electron gun according to claim 3, wherein:

the electron emitting surface of the second Wehnelt electrode is rectangular in shape;

the assembly has an electrode shaft supporting member furnished to the second Wehnelt electrode on the opposite side from the electron emitting surface thereof, and electrode shafts supported by the electrode shaft supporting member and extending along the electron emitting surface; and the emitter of the cathode is disposed at a predetermined position with respect to the second aperture of the second Wehnelt electrode in a state in which the cathode is affixed to the electrode shafts.

5. The electron gun according to claim 4, wherein the cathode is affixed by screws to one end of the electrode shafts.

6. The electron gun according to claim 5, wherein terminal blocks are furnished to the other end of the electrode shafts, and a terminal of a power supply system is detachably connected to the terminal blocks.

7. The electron gun according to claim 6, further comprising a Wehnelt cover for covering the assembly and the first Wehnelt electrode, and an attachment portion affixed to the Wehnelt cover, wherein the attachment portion is attached to another member.

8. An X-ray generator comprising an electron gun, and an anti-cathode in opposition thereto, wherein the electron gun is the electron gun according to claim 1, and the electron gun is detachably attached to the anti-cathode in a predetermined position.

9. An X-ray measurement apparatus for irradiating a sample with X-rays generated by an X-ray generator and detecting with an X-ray detector X-rays generated by the sample, wherein the X-ray generator is the X-ray generator according to claim 3.

10. The electron gun according to claim 1, wherein the cathode has a heater portion that radiates heat, and an emitter that is heated by the heater portion and emits electrons, and the emitter is inserted into the second aperture of the second Wehnelt electrode.

11. The electron gun according to claim 1, wherein:

the electron emitting surface of the second Wehnelt electrode is rectangular in shape;

the assembly has an electrode shaft supporting member furnished to the second Wehnelt electrode on the opposite side from the electron emitting surface thereof, and electrode shafts supported by the electrode shaft supporting member and extending along the electron emitting surface; and the emitter of the cathode is disposed at a predetermined position with respect to the second aperture of the second Wehnelt electrode in a state in which the cathode is affixed to the electrode shafts.

12. The electron gun according to claim 11, wherein the cathode is affixed by screws to one end of the electrode shafts.

13. The electron gun according to claim 11, wherein terminal blocks are furnished to the other end of the electrode shafts, and a terminal of a power supply system is detachably connected to the terminal blocks.

14. The electron gun according to claim 1, further comprising a Wehnelt cover for covering the assembly and the first Wehnelt electrode, and an attachment portion affixed to the Wehnelt cover, wherein the attachment portion is attached to another member.

* * * * *